US005522350A

United States Patent [19]

Hollis

[11] Patent Number: 5,522,350

[45] Date of Patent: Jun. 4, 1996

[54] SYSTEM FOR DITHERING SOLENOIDS OF HYDRAULICALLY OPERATED VALVES AFTER ENGINE IGNITION SHUT-OFF

[76] Inventor: Thomas J. Hollis, 5 Roxbury Dr., Medford, N.J. 08055

[21] Appl. No.: 447,471

[22] Filed: May 23, 1995

[51] Int. Cl.[6] ..... F01P 7/14

[52] U.S. Cl. ..... 123/41.1

[58] Field of Search ..... 123/41.08, 41.1

[56] References Cited

U.S. PATENT DOCUMENTS

| | | | |
|---|---|---|---|
| Re. 30,115 | 10/1979 | Herd et al. | 251/63.6 |
| 2,650,609 | 9/1953 | Herbst | 137/596.14 |
| 2,799,466 | 7/1957 | Hickerson | 251/30.03 |
| 3,621,907 | 11/1971 | Ephraim, Jr. et al. | 123/41.08 |
| 4,357,912 | 11/1982 | Brown | 123/41.08 |
| 4,413,595 | 11/1983 | Potts, Jr. | 123/142.5 R |
| 4,484,541 | 11/1984 | Yokoyama | 123/41.1 |
| 4,982,902 | 1/1991 | Knapp et al. | 251/129.16 |

OTHER PUBLICATIONS

Hydraulic Handbook, dated Jan. 30, 1958, p. 502.

*Primary Examiner*—Noah P. Kamen
*Attorney, Agent, or Firm*—Seidel Gonda Lavorgna & Monaco

[57] ABSTRACT

A system for controlling the flow of hydraulic fluid in lines leading to and from a solenoid injector which actuates a temperature control valve. The solenoid injector controls the actuation a temperature control valve between a first state for inhibiting flow of temperature control fluid and a second state for allowing flow of a temperature control fluid. The solenoid injector receives a flow of pressurized hydraulic fluid along the hydraulic line from a fluid reservoir. In order to drain the hydraulic fluid from the hydraulic line after engine shut-off, the hydraulic line is dithered in accordance with a predetermined schedule. An engine computer determines when the engine has been shut-off. After determining that the engine has been shut-off, the engine computer sends signals to the solenoid injector causing it to actuate between its open and closed positions in accordance with a predetermined schedule.

9 Claims, 11 Drawing Sheets

SYSTEM FOR DITHERING SOLENOIDS OF HYDRAULICALLY OPERATED VALVES AFTER ENGINE IGNITION SHUT-OFF

CROSS-REFERENCE TO RELATED APPLICATION

This application is related to co-pending U.S. application Ser. No. 08/390,711, filed Feb. 17, 1995 and entitled "SYSTEM FOR MAINTAINING ENGINE OIL AT AN OPTIMUM TEMPERATURE," which is a continuation-in-part of co-pending U.S. application Ser. No. 08/306,272 filed Sep. 14, 1994 and entitled "SYSTEM FOR DETERMINING THE APPROPRIATE STATE OF A FLOW CONTROL VALVE AND CONTROLLING ITS STATE," the entire disclosures of both of these applications is incorporated herein by reference. This application is also related to co-pending U.S. application Ser. No. 08/306,240, filed Sep. 14, 1994 and entitled "HYDRAULICALLY OPERATED ELECTRONIC ENGINE TEMPERATURE CONTROL VALVE," and to co-pending U.S. application Ser. No. 08/306,281, filed Sep. 14, 1994 and entitled "HYDRAULICALLY OPERATED RESTRICTOR/SHUTOFF FLOW CONTROL VALVE," the entire disclosures of both of these applications is also incorporated herein by reference.

FIELD OF THE INVENTION

This invention relates to a system for controlling the hydraulic fluid flow between a flow control valve and a reservoir within an internal combustion gasoline or diesel engine equipped with a radiator.

BACKGROUND OF THE INVENTION

Page 111 of the *Goodheart—Willcox automotive encyclopedia*, The Goodheart-Willcox Company, Inc., South Holland, Ill., 1979 describes that as fuel is burned in an internal combustion engine, about one-third of the heat energy in the fuel is converted to power. Another third goes out the exhaust pipe unused, and the remaining third must be handled by a cooling system. This third is often underestimated and even less understood.

Most internal combustion engines employ a pressurized cooling system to dissipate the heat energy generated by the combustion process. The cooling system circulates water or liquid coolant through a water jacket which surrounds certain parts of the engine (e.g., block, cylinder, cylinder head, pistons). The heat energy is transferred from the engine parts to the coolant in the water jacket. In hot ambient air temperature environments, or when the engine is working hard, the transferred heat energy will be so great that it will cause the liquid coolant to boil (i.e., vaporize) and destroy the cooling system. To prevent this from happening, the hot coolant is circulated through a radiator well before it reaches its boiling point. The radiator dissipates enough of the heat energy to the surrounding air to maintain the coolant in the liquid state.

In cold ambient air temperature environments, especially below zero degrees Fahrenheit, or when a cold engine is started, the coolant rarely becomes hot enough to boil. Thus, the coolant does not need to flow through the radiator. Nor is it desirable to dissipate the heat energy in the coolant in such environments since internal combustion engines operate most efficiently and pollute the least when they are running relatively hot. A cold running engine will have significantly greater sliding friction between the pistons and respective cylinder walls than a hot running engine because oil viscosity decreases with temperature. A cold running engine will also have less complete combustion in the engine combustion chamber and will build up sludge more rapidly than a hot running engine. In an attempt to increase the combustion when the engine is cold, a richer fuel is provided. All of these factors lower fuel economy and increase levels of hydrocarbon exhaust emissions.

To avoid running the coolant through the radiator, coolant systems employ a thermostat. The thermostat operates as a one-way valve, blocking or allowing flow to the radiator. FIG. 2 of U.S. Pat. No. 4,545,333 shows a typical prior an thermostat controlled coolant systems. Most prior an coolant systems employ wax pellet type or bimetallic coil type thermostats. These thermostats are self-contained devices which open and close according to precalibrated temperature values.

Coolant systems must perform a plurality of functions, in addition to cooling the engine parts. In cold weather, the cooling system must deliver hot coolant to heat exchangers associated with the heating and defrosting system so that the heater and defroster can deliver warm air to the passenger compartment and windows. The coolant system must also deliver hot coolant to the intake manifold to heat incoming air destined for combustion, especially in cold ambient air temperature environments, or when a cold engine is started. Ideally, the coolant system should also reduce its volume and speed of flow when the engine pans are cold so as to allow the engine to reach an optimum hot operating temperature. Since one or both of the intake manifold and heater need hot coolant in cold ambient air temperatures and/or during engine start-up, it is not practical to completely shut off the coolant flow through the engine block.

Practical design constraints limit the ability of the coolant system to adapt to a wide range of operating environments. For example, the heat removing capacity is limited by the size of the radiator and the volume and speed of coolant flow. The state of the self-contained prior art wax pellet type or bimetallic coil type thermostats is controlled solely by coolant temperature. Thus, other factors such as ambient air temperature cannot be taken into account when setting the state of such thermostats.

Numerous proposals have been set forth in the prior art to more carefully tailor the coolant system to the needs of the vehicle and to improve upon the relatively inflexible prior art thermostats. Several of these prior art systems are described in co-pending U.S. application Ser. No. 08/390,711 which is identified above and incorporated herein by reference.

The above referenced co-pending related applications disclose a unique temperature control system for controlling the flow of temperature control fluid in an internal combustion engine. These co-pending applications also discuss in detail the effect that cold temperatures have on the oil in an engine. Specifically, when the temperature of the oil in an engine falls below approximately 190 degrees Fahrenheit, sludge begins to develop which contaminates the oil. This typically occurs in prior art thermostatic engines during start-up and warm-up. During these periods of operation, the coolant temperature rises more rapidly than the internal engine temperature. Since the thermostat is actuated by coolant temperature, it often opens before the internal engine temperature has reached its optimum value, thereby causing coolant in the water jacket to prematurely cool the engine. As a result, a cold running engine will have less complete combustion in the engine combustion chamber and will build up sludge more rapidly than a hot running engine.

In co-pending U.S. application Ser. No. 08/306,240, a novel electronic engine temperature control valve (hereafter, "EETC valve") is disclosed which controls the flow of the temperature control fluid through the engine so as to maintain the engine at or near its optimum temperature. One embodiment of the EETC valve disclosed in that application utilizes hydraulic oil from the oil pan to actuate the valve.

When the hydraulic oil flowing in the fluid lines to and from the valve is relatively hot, such as during normal engine operation, the actuation of the valve is relatively quick and smooth. However, when the oil in the lines begins to cool, such as after the engine is shut-off, the viscosity of the oil will increase resulting in slower and less smooth actuation of the valve. This adversely affects the operation of the valve.

A need therefore exists for an system which minimizes the hydraulic fluid remaining within the lines leading to a hydraulically operated valve in an engine after the engine has been shut-off.

SUMMARY OF THE INVENTION

The present invention provides a system for controlling the flow of hydraulic fluid in lines leading to and from a valve. In one embodiment of the invention, a method is provided for dithering a hydraulic line in fluidic communication with a solenoid injector. The solenoid injector controls the actuation a temperature control valve between a first state for inhibiting flow of temperature control fluid and a second state for allowing flow of a temperature control fluid. The solenoid injector receives a flow of pressurized hydraulic fluid along the hydraulic line from a fluid reservoir. The dithering of the hydraulic line is adapted to drain the hydraulic fluid from the hydraulic line after engine shut-off. The preferred method involves the steps of determining when the engine has been shut-off, and actuating the solenoid injector between its open and closed positions in accordance with a predetermined schedule.

In another embodiment of the invention a system is disclosed for dithering a hydraulic tube to drain hydraulic fluid therefrom after engine shut-off. The system includes a temperature control valve adapted for controlling flow of a temperature control fluid between a first and second passageway. The temperature control valve has a first state for inhibiting flow the fluid flow and a second state for allowing the fluid flow. At least one solenoid injector is in fluidic communication with the temperature control valve. The solenoid injector has an open and a closed position and is adapted for transmitting hydraulic fluid to the temperature control valve for actuating the valve between the first and second state. At least one hydraulic fluid tube provides fluid to the solenoid injector from a hydraulic fluid source. An engine computer, in communication with the solenoid injector, controls the operation of the solenoid injector. The engine computer determines when the engine is shut-off, whereupon signals are sent to the solenoid injector. The signals causes the solenoid injector to open and close in accordance with a predetermined schedule.

The foregoing and other features and advantages of the present invention will become more apparent in light of the following detailed description of the preferred embodiments thereof, as illustrated in the accompanying figures.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE PREFERRED EMBODIMENTS

While the invention will be described in connection with a preferred embodiment, it will be understood that it is not intended to limit the invention to that embodiment. On the contrary it is intended to cover all alternatives, modifications and equivalents as may be included within the spirit and scope of the invention as defined by the appended claims.

Certain terminology is used herein for convenience only and is not be taken as a limitation on the invention. Particularly, words such as "upper," "lower," "left," "right," "horizontal," "vertical," "upward," and "downward" merely describe the configuration shown in the figures. Indeed, the valves and related components may be oriented in any direction. For example while a vertically oriented radiator is illustrated in the figures, a horizontally oriented radiator is well within the scope of the invention. The term "inhibiting" is intended to cover both partial and full prevention of fluid flow.

Figure 1:
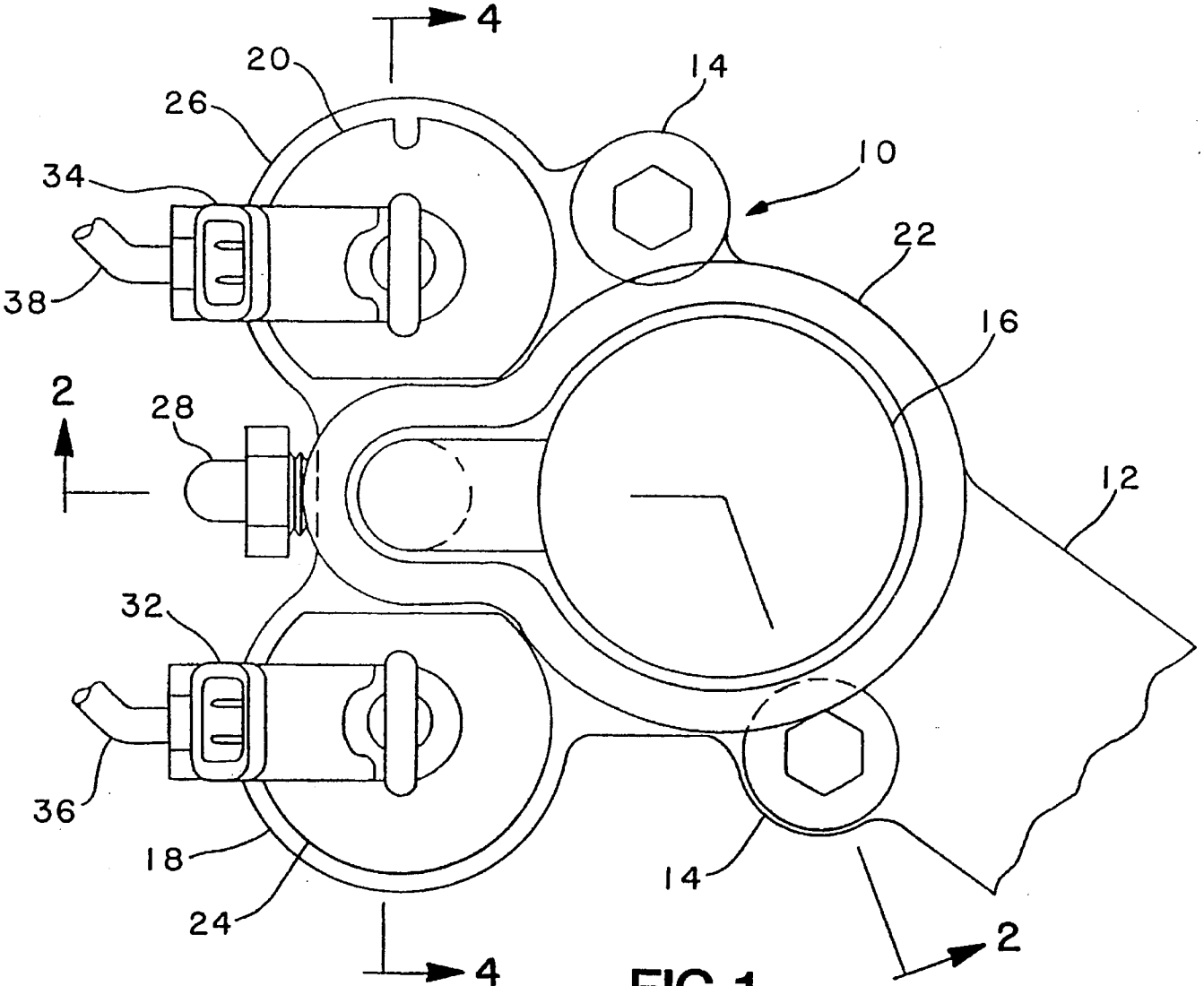
FIG. 1 is a top plan view of one a hydraulically operated electronic engine temperature control valve for controlling the flow of temperature control fluid in an engine.

FIG. 1 shows a top plan view of electronic engine temperature control valve 10 (hereafter, "EETC valve 10") as it would appear attached to an engine temperature control fluid passageway 12. (Only a portion of the passageway 12 is visible in this view.) The EETC valve 10 includes two major subcomponents, a valve mechanism 16 and a pair of solenoid actuated hydraulic fluid injectors 18 and 20. The injector 18 is a fluid inlet valve and the injector 20 is a fluid outlet valve. In effect, the injectors 18, 20 are one-way flow through valves. The view in FIG. 1 shows valve housing sub-parts including housing 22 of the valve mechanism 16 and housings 24 and 26 of the respective hydraulic fluid injectors 18 and 20. The EETC valve 10 also includes fluid pressure sensor 28 mounted to the valve housing through insert 30.

Also visible in FIG. 1 are electrical terminals 32, 34, and fluid inlet and outlet lines or tubes 36, 38, associated with respective fluid injectors 18 and 20. These tubes are attached to respective solid tubes which feed into the valve housing through inserts 30. Those inserts 30 are not visible in this view. However, the insert 30 associated with the inlet tube 36 is visible in FIG. 3. The inlet tube 36 is connected to a source of pressurized hydraulic fluid, such as engine lubrication oil. The outlet tube 38 is connected to a low pressure reservoir of the hydraulic fluid, such as an engine lubrication oil pan. Each of the electrical terminals 32, 34 are connected at one end to a solenoid inside of its respective fluid injector (not shown) and at the other end to a computerized engine electronic control unit (ECU) (not shown).

Figure 2:
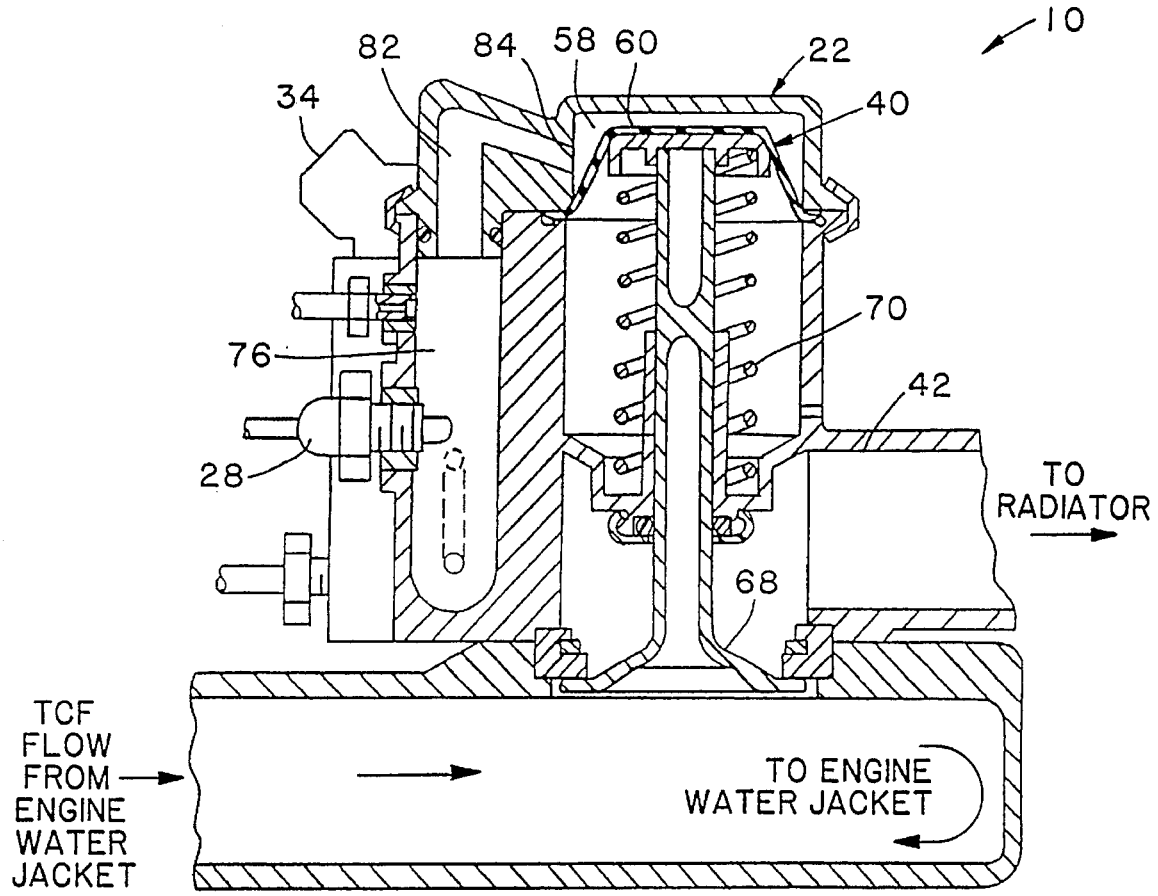
FIG. 2 is a sectional side view of the valve in FIG. 1, taken along line 2—2 in FIG. 1 and illustrating the hydraulic fluid flow path in the valve.

FIG. 2 shows a sectional side view of one version of the EETC valve 10, taken along line 2—2 in FIG. 1. In this version, the EETC valve 10 is a hydraulically actuated diaphragm valve 40. The diaphragm valve 40 reciprocates within the valve housing 22 between a first and second state or position. In the first "closed" position, the valve 40 prevents flow of temperature control fluid (TCF) through passageway opening 42. In the second "open" position, the valve 40 allows fluid flow through the opening 42. The opening 42 leads to the engine radiator (not shown). Also visible in FIG. 2 is the electrical terminal 34 and the outlet tube 38 associated with the solenoid 20, and the fluid pressure sensor 28.

The temperature control fluid (TCF) referred to herein is typically known in the art as "coolant." Coolant is a substance, ordinarily fluid, used for cooling any part of a reactor in which heat is generated. However, as described in the co-pending applications referenced above, the TCF not only removes heat energy from engine components but is also employed in certain embodiments to deliver heat energy to certain engine components. Thus, the TCF is more than merely a coolant.

As noted above, the valve 40 reciprocates between a first "closed" position wherein the valve 40 prevents flow of TCF through passageway opening 42 and a second "open" position wherein the valve 40 allows fluid flow through the opening 42. When the valve 40 is "closed," the water pump circulates the TCF only through prescribed engine water jackets (e.g., block, intake manifold, cylinder head, etc.) and/or directly to the water pump. When the valve 40 is "open," most of the TCF flows through the radiator before it is circulated through the various engine water jackets and/or the water pump.

Figure 3:
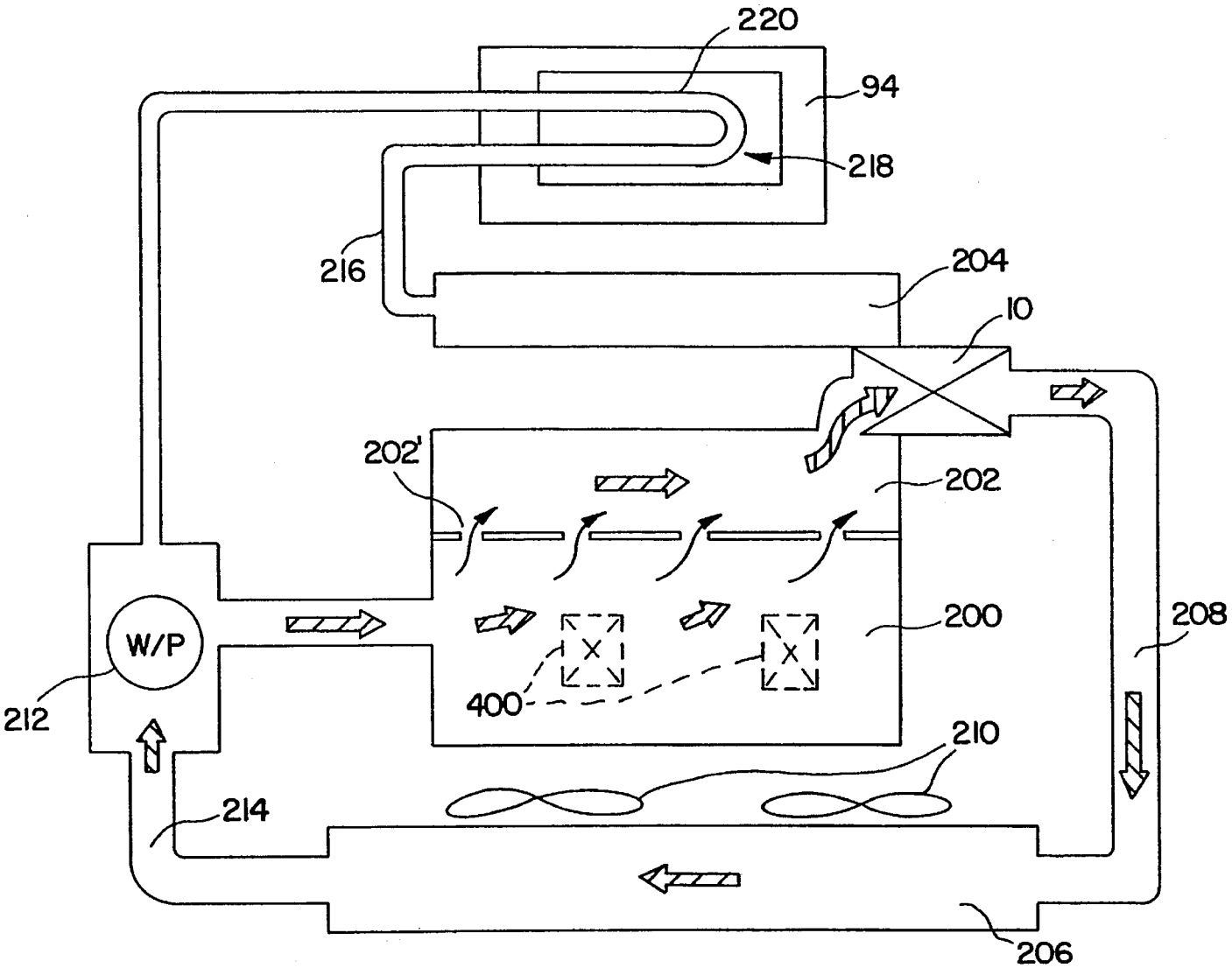
FIG. 3 is a diagrammatic illustration of one embodiment of the temperature control system according to the present invention employing the temperature control valve in a GM 3800 V6 transverse internal combustion engine during normal operation.

For example, referring to FIG. 3, a diagrammatical illustration of one embodiment of a temperature control fluid system is shown which incorporates the EETC valve 10. When the EETC valve is in its open position, the TCF flows through a flow circuit including radiator 206, waterpump 212, engine block 200, cylinder head 202, EETC valve 10 and fluid line 208. Hence, when the EETC valve 10 is open, the flow does not go through the intake manifold 204 or the oil pan 94.

When the EETC valve is closed, the TCF flows through a flow circuit including waterpump 212, block 200, cylinder head 202, EETC valve 10, intake manifold 204, oil pan 94 and back to the waterpump 212. Accordingly, when the EETC valve 10 is closed, the TCF flow does not go through the radiator 206.

The valve 40, in the embodiment of the invention shown in FIG. 2, functions in a manner similar to the prior art wax pellet thermostat. However, unlike the fixed temperature wax pellet thermostat, the valve 40 is electronically controlled and, thus, can be opened and closed according to a computer controlled signal tailored to specific engine operating conditions and ambient environmental conditions.

The diaphragm valve 40 includes upper chamber 58, diaphragm 60, valve member 68 and biasing spring 70. The position of the diaphragm 60 causes the valve member 68 to reciprocate between the first and second positions. Details of the EETC valve 10 and its operation are provided in co-pending U.S. application Ser. No. 08/306,240.

Figure 4:
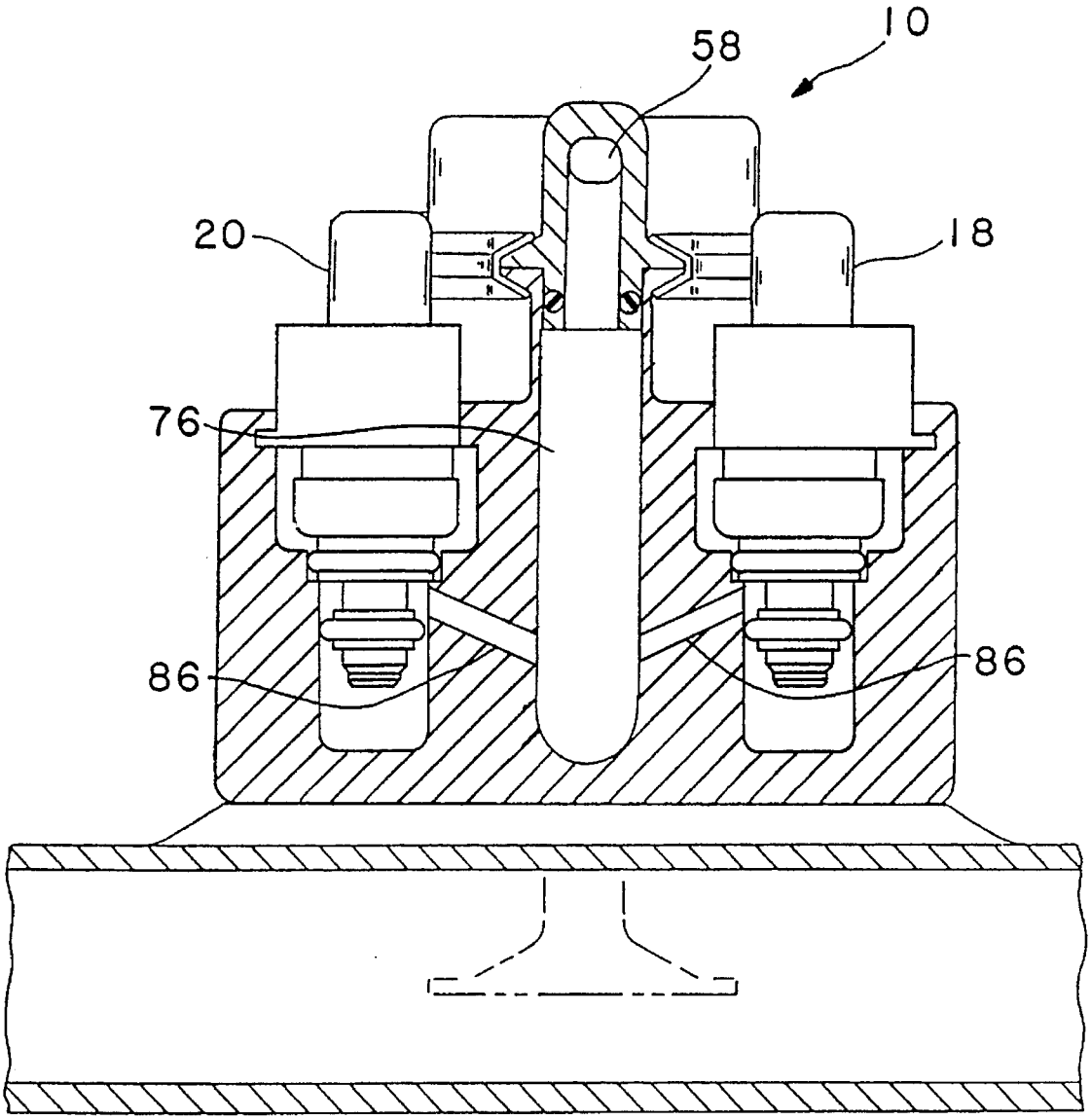
FIG. 4 is yet another sectional side view of the valve in FIG. 1, taken along line 4—4 in FIG. 1 and illustrating the hydraulic fluid flow path in the valve.

The diaphragm valve upper chamber 58 is in fluid communication with hydraulic fluid passageway 82 through opening 84 therebetween. The fluid passageway 82 is in fluid communication with the outlet of the hydraulic fluid injector 18 and the inlet of the hydraulic fluid injector 20 through the passage 6, which is best shown in FIG. 4. The fluid passageway is also in fluid communication with the fluid pressure sensor 28 to allow the pressure in the passageway to be monitored for controlling the valve state. Pressure monitoring helps to ensure that pressures do not exceed those which the valve components can safely handle.

A warning system can be incorporated which would send a signal from the pressure sensor 28 to the ECU when the pressure exceeds or falls below a predetermined limit, such as if there is a loss of hydraulic pressure. The ECU could then display a suitable warning to the operator. Additionally, override mechanisms, such as an electro-mechanical device, could be activated to lock the EETC valve 10 in the open position thereby maintaining flow to the radiator during valve failure.

As discussed above, the diaphragm valve 40 disclosed herein is actuated by pressurizing and depressurizing the upper chamber 58 with hydraulic fluid. A hydraulic fluid system has numerous advantages over a vacuum actuated system including less sensitivity to temperature extremes, and increased accuracy, durability and reliability. These are very important considerations since the EETC system must function under a multitude of extreme conditions, both environmental and physical. Accordingly, a reliable power source is required and one of the most dependable sources of hydraulic fluid in an engine is pressurized engine oil.

FIG. 4 shows fluid passageway 86 from the outlet of the hydraulic fluid injector 18 to the passage 76 leading to the diaphragm upper chamber 58, and from the upper chamber 58 to the passage 76 leading from the hydraulic fluid injector 20. Again, the fluid connections or paths between the fluid inlet and outlet tubes 36, 38 and the respective injectors 18, 20 are also not visible in this view but are understandable with respect to FIG. 6.

Figure 5:
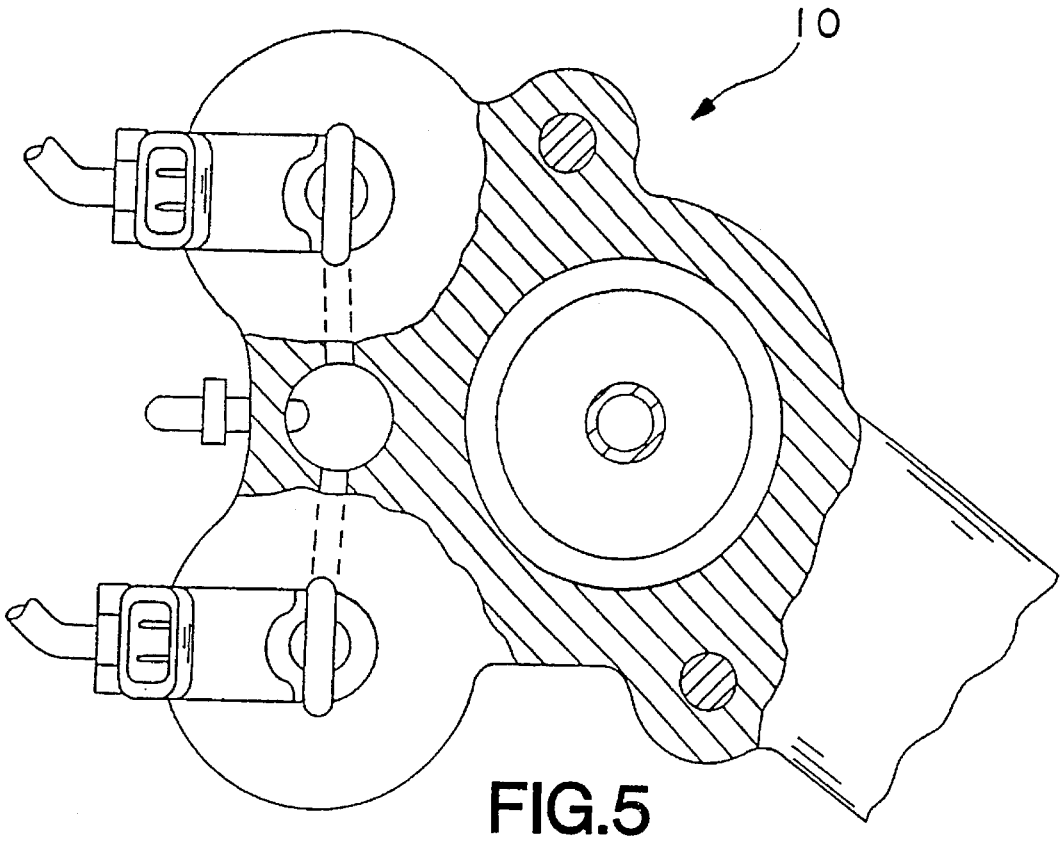
FIG. 5 is a horizontal sectional view of the valve in FIGS. 1 and 2, taken along line 5 . 5 in FIG. 2 also illustrating the hydraulic fluid flow path.

FIG. 5 is a horizontal sectional view of the EETC valve 10 in FIGS. 1 and 2, taken along line 5—5 in FIG. 2. This view shows more of the internal structure of the valve and injector parts.

Figure 6:
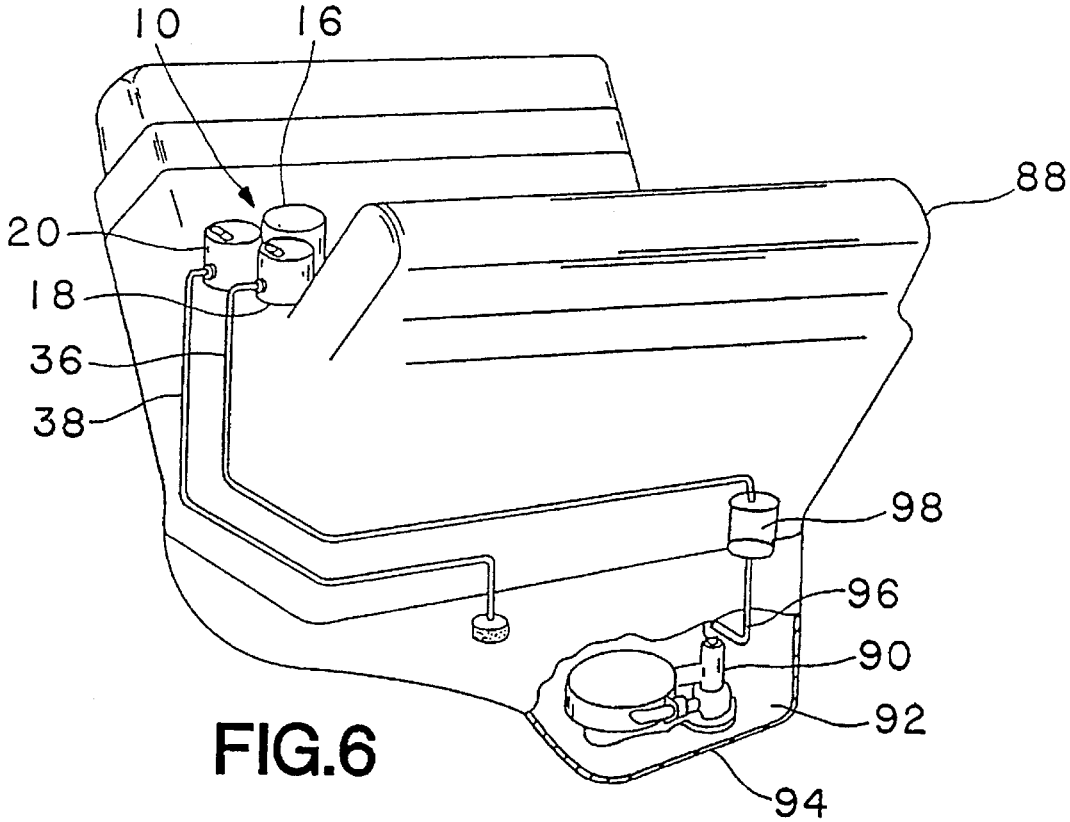
FIG. 6 is a diagrammatic view of the valve in FIG. 1 connected to the source of the hydraulic fluid in an engine.

FIG. 6 illustrates an internal combustion engine with the EETC valve 10 connected to a source of hydraulic fluid. In this embodiment of the invention, the source of hydraulic fluid is the engine lubrication oil. In FIG. 6, a portion of oil pan 94 is cut away to show engine lubrication oil pump 90 and engine lubrication oil reservoir 92 in oil pan 94. As is well known in the art, outlet 96 of the oil pump 90 feeds oil to practically all of the moving parts of the engine under pump pressure through distributing headers (not shown). To provide a source of pressurized hydraulic fluid to the inlet fluid injector 18, the fluid inlet tube 36 is connected an outlet 96 of the oil pump 90. An optional replaceable filter 98 may be placed in the pressurized oil line to ensure that the oil flowing to the valve 10 does not clog the injectors. Alternately, the pressurized oil line may tap off the existing engine oil filter, which is also a source of pressurized oil. To provide a return path for the hydraulic fluid exiting from the outlet fluid injector 20, the fluid outlet tube 38 is connected to the oil reservoir 92 in the oil pan 94.

Figure 7:
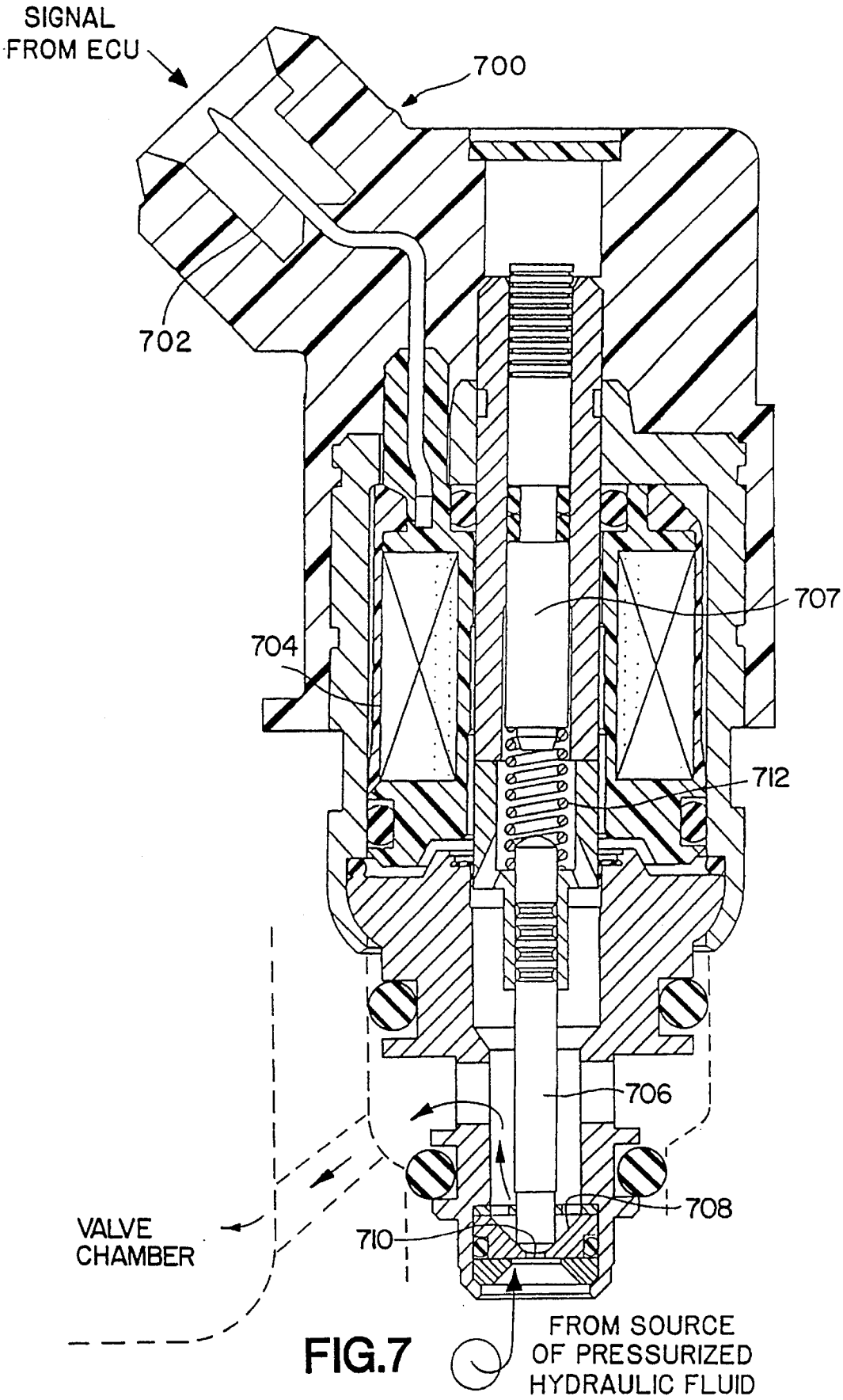
FIG. 7 is a sectional view of a hydraulic fluid injector suitable for controlling the state or position of the EETC valves.

A preferred hydraulic fluid injector 700 is shown in cross-section in FIG. 7. As noted above, the fluid injector 700 is solenoid activated and includes an electrical terminal 702 connected at one end to injector solenoid 704 and at the other end to an ECU (not shown). When the solenoid 704 is energized, it causes needle valve 706 to move up, thereby moving it away from seat 708 and opening orifice 710 to fluid flow. When the solenoid 704 is deenergized, biasing spring 712 causes the needle valve 706 to return to the closed position.

FIG. 7 shows the inlet fluid flow path from a source of pressurized hydraulic fluid, through the injector and to the valve chamber. The valve in this figure thus performs the function of the valve 18 in FIG. 4. A second hydraulic fluid injector (not shown) is used to control the flow of hydraulic fluid along the outlet fluid flow path from the valve chamber. The injector is, preferably, identical to the injector 700 shown in FIG. 7. However, the flow of hydraulic fluid would be in a direction opposite from the direction of the arrows in the figure. Co-pending U.S. application Ser. No. 08/390,711 describes the preferred hydraulic fluid injectors in detail.

Figure 8:
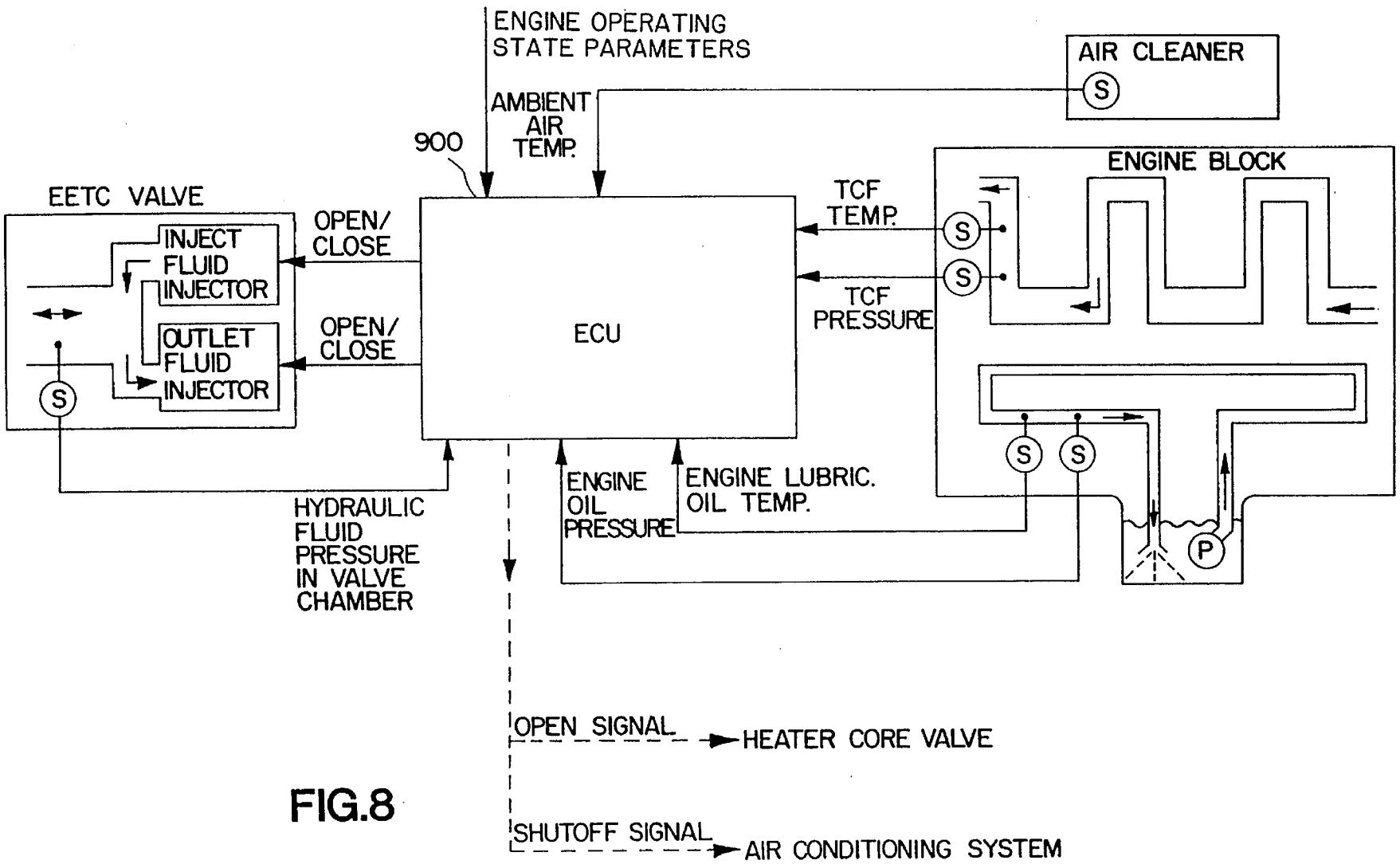
FIG. 8 is a block diagram circuit of the connections to and from an engine computer for controlling the state or position of the valves in the invention.

Referring now to FIG. 8, a block diagram circuit is shown which illustrates the preferred signals that are sent to and from the engine control unit (ECU) designated by the numeral 900. The ECU 900 utilizes the input signals, in combination with stored valve control maps, to determine the desired position or state of the EETC valve 10. The ECU 900 provides signals to the solenoids of the hydraulic injectors to actuate the valve into the desired position. A more detailed discussion on the operation of the ECU is provided in the above-referenced co-pending applications.

The operation of the EETC valve 40 will now be discussed with reference to FIG. 2. When the engine is operating and it is desired to open the valve 40, the ECU sends a control signal to the solenoid of the hydraulic fluid injector 18 to open the injector's valve. Simultaneously, the ECU sends a control signal to the solenoid of the hydraulic fluid injector 20 to close that injector's valve, if it is not already closed. Pressurized hydraulic fluid from the oil pump 90 flows through the fluid inlet tube 36, the fluid injector 18, the hydraulic fluid passageway 82, the opening 84 and into the valve upper chamber 58, where it pushes against the diaphragm 60. When the fluid pressure against the diaphragm 60 exceeds the opposing force of the biasing spring 70, the diaphragm 60 moves downward, thereby causing the valve member 68 to move downward. The upper chamber 58 expands as the diaphragm 60 moves downward. As the upper chamber 58 fills with fluid, the pressure in the chamber rises. When the pressure sensor 28 detects that the fluid pressure has reached a predetermined level, it causes the ECU to start a timer which runs for a predetermined period of time. After that time has expired, the ECU sends a control signal to the solenoid of the hydraulic fluid injector 18 to close the injector's valve. The hydraulic fluid in the upper chamber 58 thus remains trapped therein.

The predetermined pressure level and time period are empirically determined so as to allow the valve member 68 to reach its open or second position. To avoid excessively activating the injector's solenoids, the open injector valve should be closed as soon as the diaphragm valve 40 has reached the desired state. Also, a diaphragm valve 40 is selected which will always open under less pressure than exists in the hydraulic fluid system that the inlet fluid injector 18 is attached to. To remove air trapped in the upper chamber 58 and/or connected passageways, the ECU can be programmed to open the valve of the outlet fluid injector 20 for a short period of time (e.g., one second). This is similar to the technique for bleeding air from a vehicle s hydraulic braking system.

If hydraulic fluid leaks out of the upper chamber 58, the pressure sensor 28 will immediately sense this condition. The ECU responds by again sending a control signal to the solenoid of the hydraulic fluid injector 18 to open the injector's valve. When the pressure sensor 28 detects that the fluid pressure has again reached the predetermined level, it causes the ECU to start a timer which runs again for a predetermined period of time. After that time has expired, the ECU sends a control signal to the solenoid of the hydraulic fluid injector 18 to close the injector's valve.

When it is desired to close the valve 40, the above steps are reversed. That is, the ECU sends a control signal to the solenoid of the hydraulic fluid injector 18 to close the injector's valve, if it is not already closed. Simultaneously, the ECU sends a control signal to the solenoid of the hydraulic fluid injector 20 to open that injector's valve. The pressurized hydraulic fluid inside the upper chamber 58 flows out of the upper chamber 58 through the opening 84, into the hydraulic fluid passageway 82, through the open valve of the hydraulic fluid injector 20 and into the fluid outlet tube 38. The fluid outlet tube 38 connects to a reservoir (shown in FIG. 6) of hydraulic fluid which, in the preferred embodiment illustrated, is the oil pan. As the hydraulic fluid empties out of the upper chamber 58, biasing spring 70 pushes the diaphragm 60 upward, thereby causing the valve member 68 to move upward until the valve 40 becomes closed. When the pressure sensor 28 detects that the upper chamber 58 is no longer pressurized, it causes the ECU to send a control signal to the solenoid of the hydraulic fluid injector 20 to close that injector's valve.

The vehicle's engine does not need to be operating to close the valve 40. Thus, during a "hot engine off soak" (i.e., the time period subsequent to shutting off a hot engine), the valve 40 stays open since there is hydraulic fluid still trapped within the upper chamber 58. This function mimics prior art cooling systems which maintain an open path to the radiator until the thermostat's wax pellet rehardens. After the engine has cooled down, the ECU (which is powered from the vehicle's battery) causes the valve 40 to close.

The co-pending applications recited above discuss various embodiments of the temperature control system. In one embodiment, restrictor/shut-off valves are utilized in combination with the EETC valve to control the flow of temperature control fluid. Co-pending U.S. application Ser. No. 08/306,281 discusses in detail the various restrictor/shut-off valve embodiments. The restrictor/shut-off valves are also, preferably, actuated through the use of hydraulic fluid.

Figure 9:
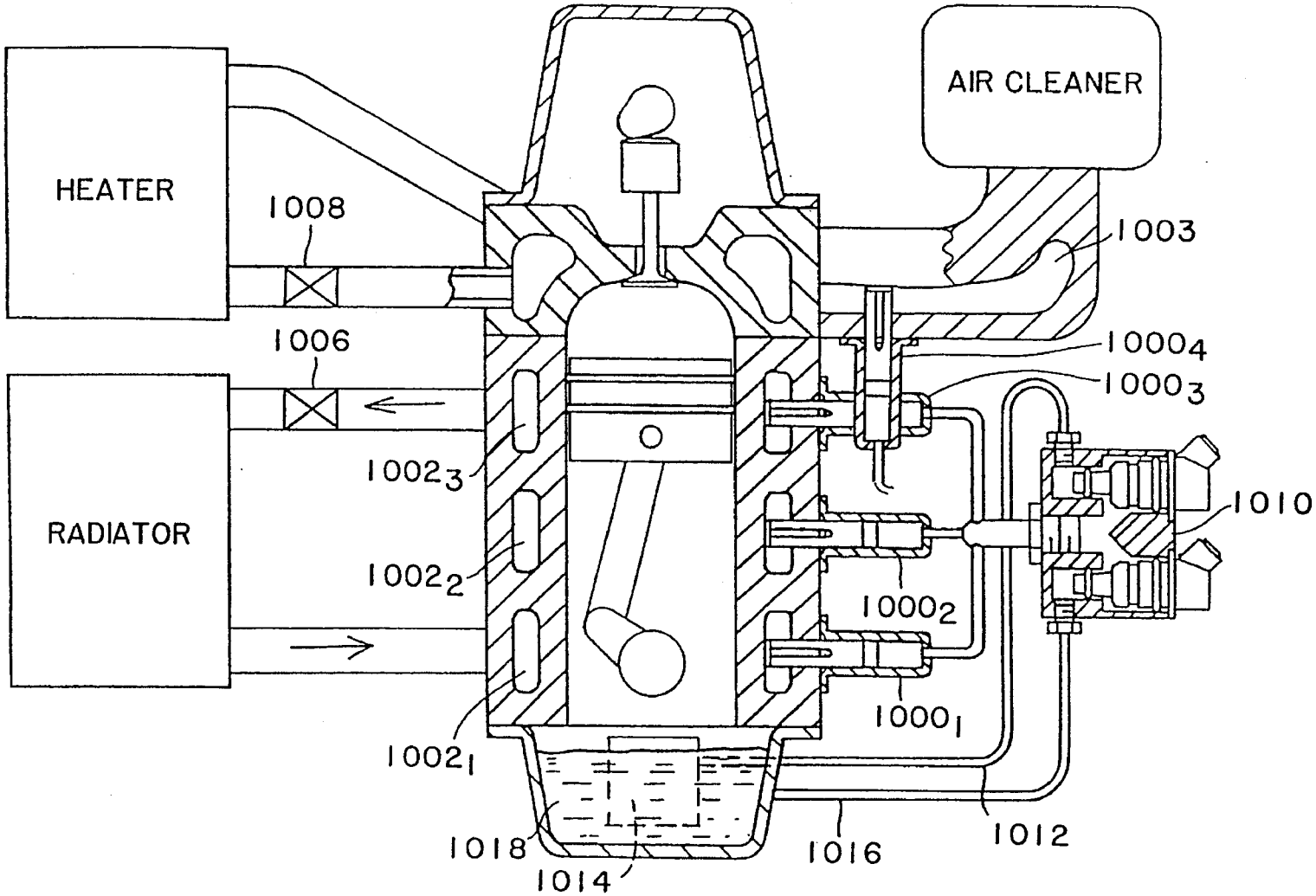
FIG. 9 is a diagrammatic sectional view of an engine block showing restrictor/shutoff flow control valves in accordance with the invention.

FIG. 9 illustrates an internal combustion engine configuration which utilizes a plurality of restrictor/shut-off valves (identified as $\mathbf{1000}_1$ through $\mathbf{1000}_4$) connected to a single set of hydraulic fluid injectors 1010. The injectors are shown attached to a hydraulic pressure source 1014 for providing pressurized fluid along fluid inlet tube 1012. The outlet fluid tube 1016 from the injectors is connected to a hydraulic fluid reservoir 1018. In this preferred embodiment, the pressurized source is the oil pump and the hydraulic fluid reservoir is the oil pan.

After the engine has been shut-off, the hydraulic fluid may not fully drain out of the hydraulic tubes 36, 38 and back into the reservoir. As a consequence, if the engine is in an environment where the ambient temperature is very cold, the viscosity of the fluid that remains in the tubes may increase such that the fluid becomes thick (e.g., molasses-like). When the engine is subsequently turned on and a signal is sent to actuate the EETC valve 10, the thick fluid may lengthen the time required to fully actuate the valve to change its state. Accordingly, the engine will not be operating as efficiently as desired. In extreme conditions, the fluid may become so thick so as to completely inhibit the actuation of the EETC valve.

In order to address this problem, the present system "dithers" the solenoids. That is, the engine control unit (ECU) 900 determines when the engine has shut-off, at which point control signals are sent to the solenoids. The control signals result in the solenoids causing the injectors to "open" and "close" a series of times. Each time the injector opens, the upper end of the fluid tube is exposed to air pressure in the EETC valve. The air pressure, working in combination with the force of gravity, causes the fluid in the tube to retreat back into the reservoir. The dithering will even work on the fluid input tube 36 which is normally filled with pressurized hydraulic fluid because, with the engine shut-off, pressure is no longer being supplied to the hydraulic fluid in the inlet tube 36. Accordingly, opening the hydraulic injector 18 associated with the fluid inlet tube 36 will not result in fluid entering passage 76 but, instead, will result in the air pressure from passage 76 entering the fluid inlet tube 36 causing the hydraulic fluid in the line to retreat to its starting point, e.g., oil pump.

An example of the dithering process is as follows. After the ECU 900 determined that the engine is shut-off, the ECU sends signals to the solenoids controlling the fluid injectors in communication with the fluid inlet and outlet tubes 36, 38. The signals direct the fluid injectors 18, 20 to open and close a predetermined number of times or according to a preprogrammed schedule. This causes air pressure from the passage 76 to enter the fluid inlet and outlet tubes 36, 38 which, acting in combination with the force of gravity, causes the fluid in the lines to return to their respective reservoirs (e.g., oil pump 94, oil pan 90).

It is preferable to dither the solenoids while the hydraulic fluid is still sufficiently warn since the viscosity of hydraulic fluid increases as its temperature decreases. Hence, when the hydraulic fluid is very warm, the dithering of the solenoids will allow the hydraulic fluid to naturally and readily flow back to its reservoir. If the dithering occurs after the hydraulic fluid has cooled, the higher viscosity of the hydraulic fluid will likely slow down its natural flow back into the reservoir. That is, the viscosity of the hydraulic fluid may increase such that the force of gravity and the pressure created by the dithering may not be sufficient to drive the fluid back into the reservoir. Accordingly, it is preferred that the dithering occur soon after the engine ignition has been turned off.

A variety of different techniques for dithering the solenoids may be practiced within the scope of this invention. For example, it may be desirable, depending on the configuration of the system, to open both hydraulic injectors simultaneously and hold them in the open position for a sufficient amount of time to permit the fluid to return to the oil pan. Alternately, and more preferably, it is desirable to open and close the injectors in a 50% duty cycle (i.e., 50% off/50% on). This is equivalent to a step function map or schedule which is, preferably, programmed into the memory of the ECU 900. The amount of cycles, the length of time that a injector is open, and the total duration of the dithering will vary depending on the system configuration (e.g., diameter of fluid tube, length of fluid tube, type of fluid utilized, etc.). Additionally, other scheduling functions may be utilized, e.g. sinusoidal, linear, logarithmic, exponential, etc. In a GM 3800 V6 transverse internal combustion engine, it has been found that dithering the injectors in a 50% duty cycle for between 5 and 30 seconds and at about 6 Hz is sufficient. More preferably, the dithering is performed for a total time of 10 seconds.

Figure 10A:
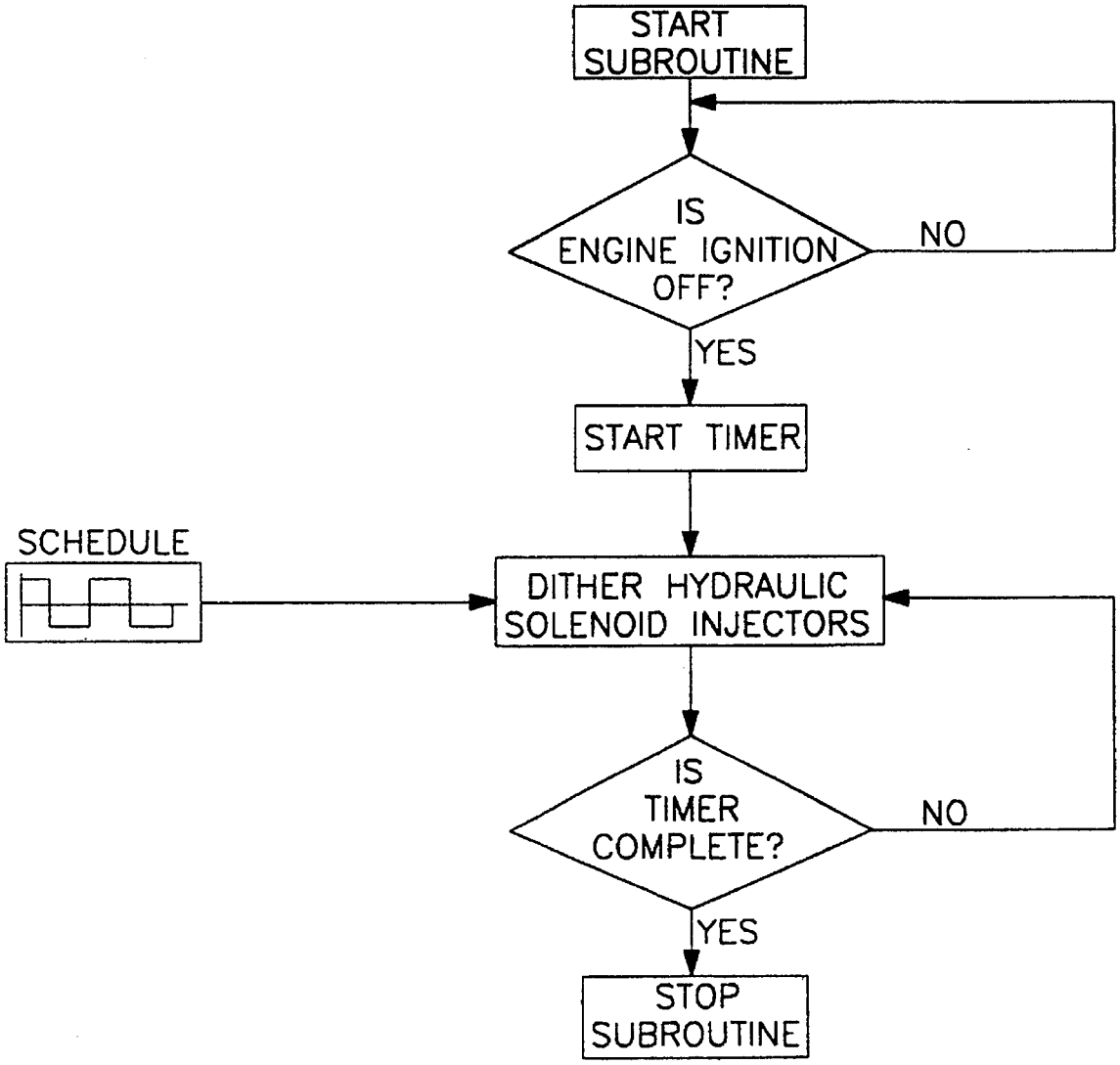
FIG. 10A is a flow chart for a first embodiment of a novel system for dithering the hydraulic injectors.

Referring now to FIG. 10A, a flow chart is shown depicting one embodiment for controlling the dithering of the hydraulic injectors. The subroutine begins by determining whether the engine ignition has been turned off. Since the dithering of the valves should only be accomplished when the engine is no longer running, this step determines when dithering is needed. In order to determine whether the ignition is on or off, the ECU 900 receives engine operating state parameters (shown in FIG. 8). A variety of signals may be utilized to determine if the engine is running, such as an ignition signal, a signal from the distributor, the engine RPM, or the engine manifold vacuum.

Once it has been determined that the engine is no longer running, the system can begin to dither the solenoids. This is accomplished by starting a timer and sending signals to the hydraulic solenoid injectors 18, 20 to open and close according to a predetermined schedule. As stated above, the predetermined schedule may simply comprise an oscillating step function curve. The dithering is continued until the timer expires whereupon the subroutine ends. The amount of dithering time required is empirically determined and, as stated above, depends on the configuration of the system. The predetermined schedule for controlling the dithering is also empirically determined based on the system configuration.

In an alternate embodiment not shown, the timer is eliminated and, instead, the predetermined schedule would control the duration of the dithering. That is, the injectors are opened and closed according to the preprogrammed schedule. Once the program schedule is complete, the dithering ends.

In the above example, the dithering was initiated immediately after the engine was shut-off. However, it is also within the purview of this invention to control the point at which the dithering of the injectors begins. That is, it is not necessary, and in many cases not preferable, to automatically dither the injectors upon engine shut-off. For example, after engine ignition shut-off, the system continuously monitors the temperature of the hydraulic fluid. When it is determined that the temperature of the hydraulic fluid has fallen below a predetermined threshold valve, $T_O$, which is chosen to be indicative of a relatively warm, low viscosity hydraulic fluid state, the system begins to dither the injectors to remove any hydraulic fluid in the tubes. This embodiment of the invention eliminates unnecessary actuation of the injectors and, therefore, does not needlessly reduce the operational life of the injector.

Figure 10B:
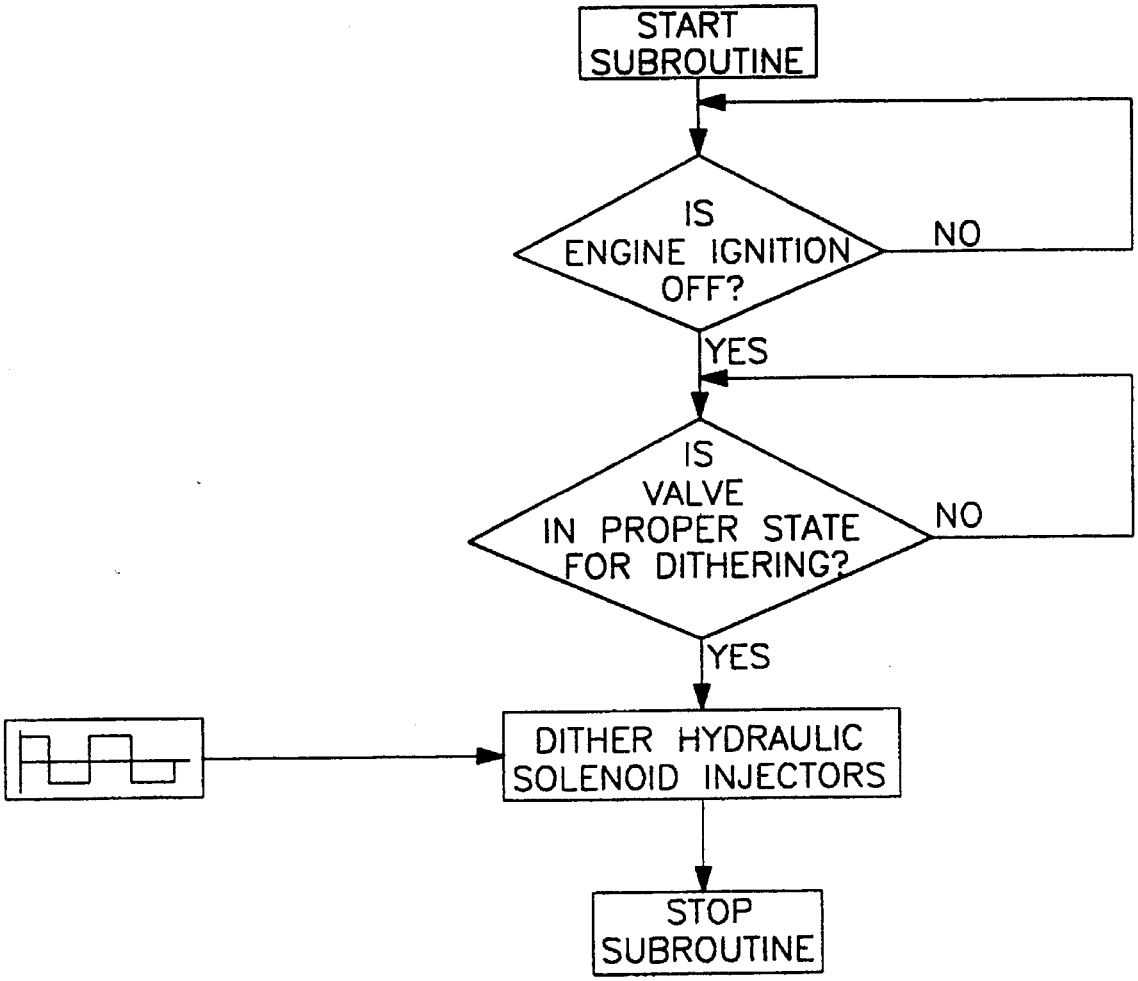
FIG. 10B is a flow chart for a second embodiment of a novel system for dithering the hydraulic injectors.

An alternate and more preferred embodiment of the invention is illustrated in FIG. 10B. In this embodiment, the system determines when the engine has been shut-off as described above. The system then determines whether the valve, which is this case is the EETC valve, is open or closed. If the valve is closed, i.e., inhibiting TCF flow to the radiator, the system begins to dither the solenoids/injectors as discussed above. If the valve is not closed, i.e., the valve is open, permitting TCF flow to the radiator, then the system continuously monitors the valve state to determine when it closes, at which point the dithering of the solenoids commences.

This preferred embodiment of the dithering system is related to the "hot engine off soak" described above. More specifically, after the system determines that the engine has been shut-off, it then determines the state of the valve 40 by comparing the sensed TCF and ambient air temperatures to the predetermined temperature control curves, such as those discussed in co-pending U.S. application Ser. No. 08/390,711. If the valve state is "open" according to the curves, the system keeps the injectors closed, continuing to trap the hydraulic fluid in the upper chamber 58 of the EETC valve 10, and thereby maintaining the flow path to the radiator. After the sensed TCF and ambient air temperatures have changed so as to define a "closed" valve state according to the temperature control curves, the ECU 900 sends a signal to open the fluid injector 20 in communication with the fluid outlet tube 36 permitting the upper chamber 58 to empty. The ECU 900 then sends a sequence of signals to the fluid injectors 18, 20 to begin dithering in accordance with a predetermined schedule.

This embodiment provides the greatest benefit in engines that are frequently shut-off for only short periods of time before being restarted, such as delivery vans in urban environments. During these short periods of shut-off, the temperature of the hydraulic fluid in these engines is not likely to fall below the temperature at which the viscosity begins to become excessive. Accordingly, there is no need to dither the hydraulic injectors unless it is determined that the engine is beginning to cool significantly. Additionally, when the engine is restarted and while the hydraulic oil is very hot, it is preferable that the temperature control fluid be allowed to circulate through the radiator for cooling. Hence, maintaining the EETC valve in its open position after the engine is initially shut-off permits this desired result to be immediately achieved without the delay associated with the actuation of the valve. While the above embodiments have been directed, primarily, to the dithering of the solenoids associated with valves such as the EETC valve 10, the invention also encompasses the dithering of the hydraulically actuated restrictor/shut-off valves discussed above. However, after the engine ignition is shut-off, if it is determined that the restrictor/shut-off valves are in the actuated position such that the flow of TCF is restricted in the water jacket, then it is preferable that the solenoids associated with the restrictors/shut-off valves and not be dithered regardless of the temperature of the hydraulic fluid.

The primary intent with this embodiment of the invention is to prepare the engine for start-up. That is, if it is determined that the restrictor/shut-off valves are actuated just prior to engine ignition shut-off, then it is likely that the engine is relatively cold (i.e., below its optimum operating temperature) and, accordingly, the valves are restricting the flow of TCF through the water jacket in order to increase the engine temperature. Therefore, since the temperature of the engine would not likely have risen after it was shutoff, upon restarting the engine will need to be heated up as quickly as possible to bring it to its optimum operating temperature. In order to achieve this, the restrictor/shut-off valves should be in their actuated (restricted) position. Hence, by preventing dithering of the injectors in the restrictor/shut-off valves when they are already actuated, the system assists in preparing the engine for restarting.

It should be apparent that, in this embodiment of the invention, if the restrictors are already actuated, the viscosity of the hydraulic fluid in the lines leading to and from the restrictor/shut-off valves is of no concern at restarting. Additionally, based on the temperature control curves, the hydraulic fluid will be at a significantly higher temperature (and lower viscosity) when it becomes desirable to retract the restrictor/shut-off valves.

If the restrictor/shut-off valves are not actuated (unrestricted flow position) when the engine is shut-off, then the temperature of the TCF at shut-off is relatively hot. When the engine is later restarted, it is preferable that the restrictor/shut-off valves be actuated immediately to reduce the flow of TCF and, thereby, heat up the engine quicker. In order to prepare the restrictor/shut-off valves for immediate actuation, the present invention dithers the valves in a similar fashion to the embodiments described above for the EETC valve. This will minimize any delay in the actuation of the valves caused by the high viscosity hydraulic fluid.

Figure 10C:
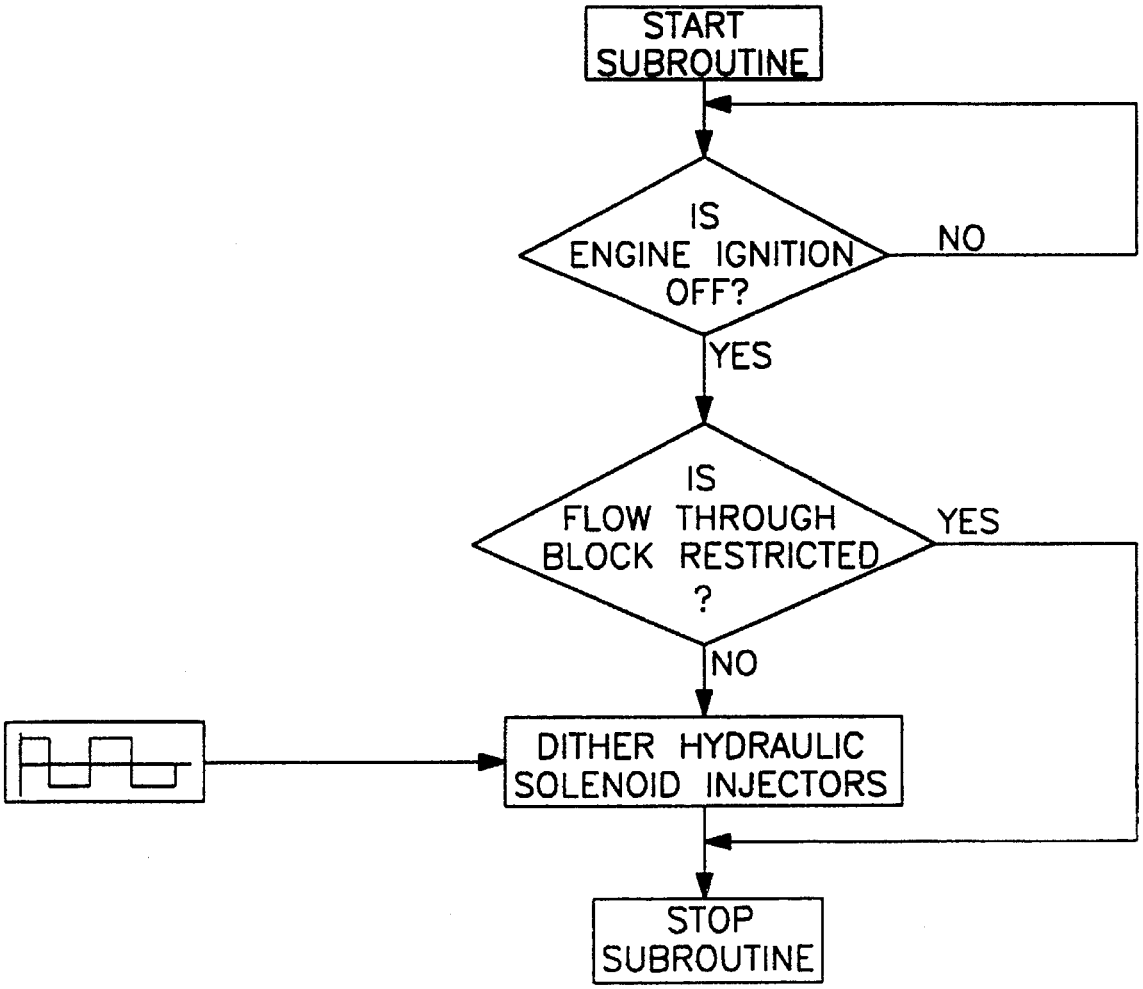
FIG. 10C is a flow chart for a third embodiment of a novel system for dithering the hydraulic injectors.

FIG. 10C illustrates a flow chart of the preferred embodiment for dithering the restrictor/shut-off valves.

It should be noted that in the above embodiments directed to the EETC valve, the "open" position or state (permitting TCF flow to radiator) of the valve corresponds to the "actuated" position of the valve wherein the hydraulic fluid fills the chamber 58. However, it is well within the purview of this invention to encompass an embodiment where in the "actuated" position of the EETC valve corresponds to the "closed" position of the valve (inhibiting TCF flow to radiator). In such an embodiment, the dithering of the valve would be similar to the restrictor/shut-off valve. More specifically, if the valve is actuated in the closed state when the engine is shut-off, (inhibiting TCF flow to the radiator), then the temperature of the TCF is relatively low. In this condition, the solenoids on the EETC valve are not dithered after engine shut-off and the hydraulic fluid is kept trapped in the chamber 58 so as to maintain the valve in the actuated (closed) position. If, on the other hand, the valve is open (unactuated) after engine shut-off (permitting TCF flow to the radiator), then the temperature of the TCF is relatively hot and, therefore, it is preferable to dither the solenoids after engine shut-off to remove the hydraulic fluid in the lines. More preferably, the dithering occurs after the valve closes in accordance with the "hot engine off soak" described above.

Although the invention has been described and illustrated with respect to the exemplary embodiments thereof, it should be understood by those skilled in the art that the foregoing and various other changes, omissions and additions may be made therein and thereto, without departing from the spirit and scope of the present invention.

I claim:

1. A method for dithering a hydraulic line in fluidic communication with a solenoid injector adapted for draining hydraulic fluid therefrom after engine shut-off, the solenoid injector having an open and a closed position, the solenoid injector being operative for actuating a temperature control valve between a first state for inhibiting flow of temperature control fluid and a second state for allowing flow of a temperature control fluid, wherein the method comprises the steps of:

(a) determining if the engine has been shut-off; and (b) actuating the solenoid injector between the open position and the closed position in accordance with a predetermined schedule.

2. A system for dithering a hydraulic tube to drain hydraulic fluid therefrom after engine shut-off, the system comprising:

a temperature control valve adapted for controlling flow of a temperature control fluid between a first and second passageway, the temperature control valve having a first state for inhibiting flow the fluid flow and a second state for allowing the fluid flow;

at least one solenoid injector in fluidic communication with the temperature control valve, the solenoid having an open and a closed position, the solenoid injector being adapted for transmitting hydraulic fluid to the temperature control valve for actuating the valve between the first and second state;

a hydraulic fluid source;

at least one hydraulic fluid tube attached to the solenoid injector for transmitting hydraulic fluid from the hydraulic fluid source to the solenoid injector; and an engine computer in communication with the solenoid injector for controlling the operation of the injector, the engine computer determining when the engine is shut-off, the engine computer providing signals to the solenoid injector in accordance with a predetermined schedule when the engine is shut-off, the signals causing the solenoid injector to open and close.

3. A method for dithering a hydraulic line in fluidic communication with a solenoid injector adapted for draining hydraulic fluid therefrom after engine shut-off, the solenoid injector having an open and a closed position, the solenoid injector being operative for actuating a temperature control valve between a first state for inhibiting flow of temperature control fluid and a second state for allowing flow of a temperature control fluid, wherein the method comprises the steps of:

(a) determining if the engine has been shut-off;

(b) determining the state of the temperature control valve;

(c) actuating the solenoid injector between the open position and the closed position in accordance with a predetermined schedule when the temperature control valve is in a desired state.

4. A method for dithering a hydraulic line according to claim 3 wherein the desired state of the temperature control valve is the first state.

5. A method for dithering a hydraulic line according to claim 3 wherein the desired state of the temperature control valve is the second state.

6. A system for dithering a hydraulic tube to drain hydraulic fluid therefrom after engine shut-off, the system comprising:

a temperature control valve adapted for controlling flow of a temperature control fluid between a first and second passageway, the temperature control valve having a first state for inhibiting flow the fluid flow and a second state for allowing the fluid flow;

at least one solenoid injector in fluidic communication with the temperature control valve, the solenoid having an open and a closed position, the solenoid injector being adapted for transmitting hydraulic fluid to the temperature control valve for actuating the valve between the first and second state;

a hydraulic fluid source;

at least one hydraulic fluid tube attached to the solenoid injector for transmitting hydraulic fluid from the hydraulic fluid source to the solenoid injector; and an engine computer in communication with the solenoid injector for controlling the operation of the injector, the engine computer determining when the engine is shut-off and determining the state of the temperature control valve, the engine computer providing signals to the solenoid injector in accordance with a predetermined schedule when the engine is shut-off and the control valve is in a desired state, the signals causing the solenoid injector to open and close.

7. A system for dithering according to claim 6 wherein the desired state is the first state wherein flow of the temperature control fluid is inhibited between the first and second passageways.

8. A system for dithering according to claim 6 wherein the desired state is the second state wherein flow of the temperature control fluid is allowed between the first and second passageways.

9. A method for dithering a hydraulic line in fluidic communication with a solenoid injector adapted for draining hydraulic fluid therefrom after engine shut-off, the solenoid injector having an open and a closed position, the solenoid injector being operative for actuating a temperature control valve between a first state for inhibiting flow of temperature control fluid and a second state for allowing flow of a temperature control fluid, wherein the method comprises the steps of:

(a) determining if the engine has been shut-off;

(b) actuating the solenoid injector between the open position and the closed position in accordance with a predetermined schedule which oscillates the solenoid injector between the open position and the closed position.

* * * * *